United States Patent [19]

Gore

[11] 4,256,259

[45] Mar. 17, 1981

[54] INSULATED RAIL JOINT

[75] Inventor: William C. Gore, Elgin, Ill.

[73] Assignee: Portec, Inc., Oak Brook, Ill.

[21] Appl. No.: 910,875

[22] Filed: May 30, 1978

[51] Int. Cl.[3] ..... E01B 11/54; E01B 11/10

[52] U.S. Cl. ..... 238/160; 238/152; 238/159

[58] Field of Search ..... 238/152, 153, 154, 155, 238/156, 157, 158, 159, 160, 161, 243, 244, 283

[56] References Cited

U.S. PATENT DOCUMENTS

| | | | |
|---|---|---|---|
| 836,953 | 11/1906 | Wolhaupter | 238/156 |
| 1,315,690 | 9/1919 | Thomson | 238/155 |
| 1,329,982 | 2/1920 | Lupo | 238/243 |
| 1,446,690 | 2/1923 | Braine | 238/155 |
| 1,769,651 | 7/1930 | Schermerhorn | 238/155 |
| 2,066,797 | 1/1937 | Oettinger | 238/160 |
| 3,295,760 | 1/1967 | Moses | 238/283 |
| 3,416,728 | 12/1968 | Hamilton, Jr. | 238/152 |

*Primary Examiner*—Randolph A. Reese
*Attorney, Agent, or Firm*—Emory L. Groff, Jr.

[57] ABSTRACT

A rail joint includes an insulative base piece insertable between a rail base flange and a joint bar. The ends of the base piece project longitudinally beyond the respective ends of the joint bar to provide exposed terminal sections with an intermediate central section. Longitudinal migration of the base piece during travel over the rail joint is precluded by one or more end abutment members fixedly disposed relative the base piece and including an elevated inner abutment surface intermediate the central section and each terminal section and engaging the joint bar ends. The abutment members may comprise integral elevated tabs cut from the base piece or alternatively, separate members insertable through cut-out portions in the base piece terminal sections.

1 Claim, 3 Drawing Figures

INSULATED RAIL JOINT

This invention relates generally to rail joints and more particularly, to an improved insulated rail joint including an insulative base member provided with means to preclude migration of the base member during passage of rail traffic over the joint.

The present invention is especially adapted for use in a rail joint wherein joint bars of the chair type are employed. Examples of such an insulated rail joint are found in the patents to Thomson U.S. Pat. No. 1,315,690 dated Sept. 9, 1919 and Hamilton, U.S. Pat. No. 3,416,728 dated Dec. 17, 1968. In providing insulative inserts for use in such rail joints, the state of the art has progressed to such a point that superior compositions are now available in the form of synthetic resinous compounds such that little problem exists insofar as deterioration or lack of dimenisonal stability during the use of such inserts. However, experience has shown that regardless of the composition of the insulative inserts, the cumulative effect of rail traffic passing over such a rail joint invariably produces a migration or creeping displacement of the insulative inserts in a longitudinal direction with one end of the insert eventually disappearing from view between one end of the joint bar and the juxtaposed rail base flange while the other end of the insert travels progressively away from the opposite end of the joint bar with the ultimate effect that the insulative integrity of the assembled joint is compromised.

By the present invention an improved insulated rail joint is provided wherein an insulative insert or base piece adapted to be inserted intermediate a rail base flange and the foot portion of a joint bar is constructed with exposed terminal sections longitudinally projecting beyond both ends of a joint bar. Fixedly disposed relative the top surface of each of the terminal sections of the base piece are stop or end abutment members forming elevated elements having an inner abutment surface juxtaposed each end of the joint bar such that the joint bar is in effect sandwiched between the spaced apart abutment surfaces of the two stop members whereupon the base piece is precluded from longitudinal migration in either direction during subsequent rail travel over the joint assembly.

Accordingly, one of the primary objects of the present invention is to provide an improved insulated rail joint including an insulative base piece disposed intermediate a rail base flange and joint bar and including exposed terminal sections projecting beyond the ends of the joint bar and provided with elevated stop members thereupon engageable with the joint bar ends.

A further object of the present invention is to provide an improved insulated rail joint including an insulative base piece having terminal sections extending longitudinally beyond the rail joint bar ends and provided with integral elevated stop members engageable with both ends of the joint bar.

Still another object of the present invention is to provide an improved insulated rail joint including an insulative base piece having exposed terminal sections formed with cut-out portions therein and projecting beyond the two ends of a joint bar and provided with separate stop members therethrough offering elevated abutment surfaces engageable with the joint bar ends.

Another object of the present invention is to provide an improved insulated rail joint including an insulative base piece provided with exposed terminal sections projecting beyond the two ends of a joint bar and provided with elevated stop members thereupon comprising a plurality of members disposed through cut-outs in each of the base piece terminal sections.

With these and other objects in view which will more readily appear as the nature of the invention is better understood, the invention consists in the novel construction, combination and arrangement of parts hereinafter more fully described, illustrated and claimed.

Preferred and practical embodiments of the invention are shown in the accompanying drawing in which.

Similar reference characters designate corresponding parts throughout the several figures of the drawing.

Figure 1:
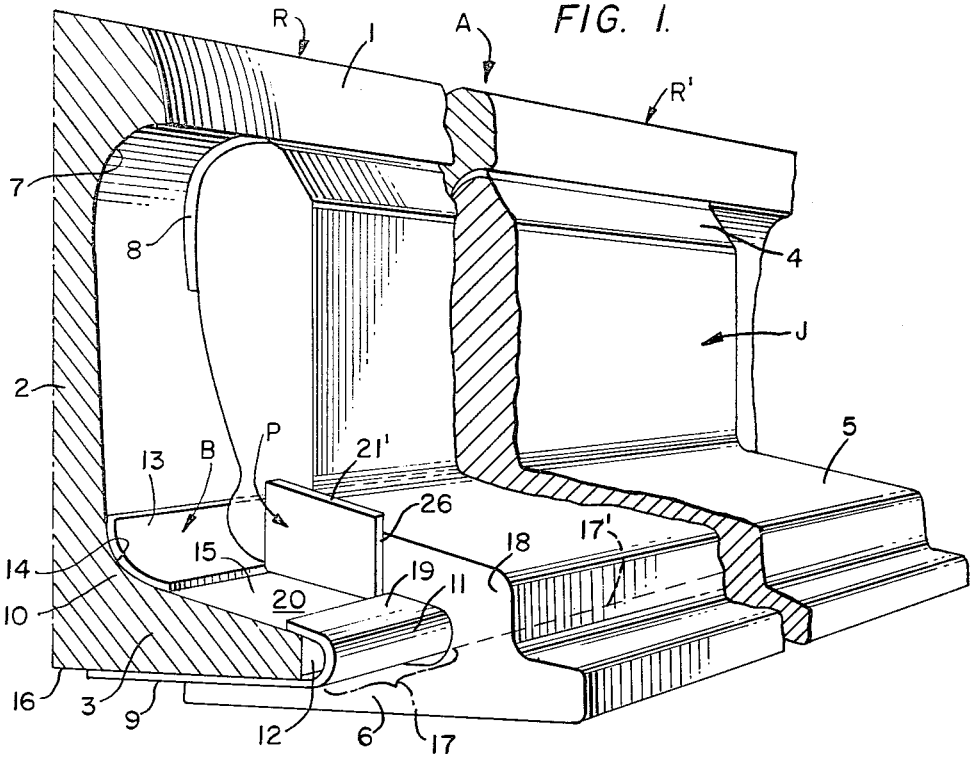
FIG. 1 is a fragmentary perspective view, partly in section, of an insulated rail joint according to the present invention.

Referring now to the drawing, particularly FIG. 1, the present invention will be seen to relate to an insulated rail joint assembly, generally designated A and which includes a pair of longitudinally aligned rails R and R′ with each rail section including the usual head 1, web 2 and base flange 3. Joining the two rail sections R and R′ is a joint bar J disposed adjacent each web 2 and having a head or upright 4 and foot 5 provided with the base 6 spaced therebeneath. As is well known in the art, the joint bar head 4 is adapted to be disposed within the head fillet 7 of the rail and is electrically isolated therefrom by means of a suitable insulative head piece 8 while the rail base flange 3 is disposed within the throat defined between the joint bar foot 5 and base 6.

The foot and base of the joint bar are electrically isolated from the base flange 3 of the rail by means of the insert or base piece B comprising a substantially V-shaped member constructed of any suitable well known insulative composition such as synthetic resin. The base piece B includes a lower arm 9 disposed beneath the rail base flange 3 and upper arm 10 disposed atop the rail base flange 3 which latter is joined to the former by means of the end wall 11. The lower arm 9 extends inwardly from a point beyond the outer edge 12 of the rail base flange to a point substantially adjacent the vertical center axis of the rail web 2 while the upper arm 10 will be seen to extend inwardly from the end wall 11 and terminates in a curved base fillet section 13 engageable with the base fillet 14 of the rail.

Quite obviously the structure illustrated in FIG. 1 of the drawing is duplicated on the other side of the rail centerline and for purposes of clarity only one set of the involved components are shown. Likewise, the illustration of the conventional joint bolts, bolt holes and end post are omitted as these components form no part of the present invention and are well known to those skilled in the present art.

For ease of assembly the base piece B is usually constructed to provide a member having limited resilience and is configured such that when slipped over a rail base flange 3 a close continuous contact is achieved between the upper arm 10 and the top surface 15 of the rail base flange as well as between the lower arm 9 and the bottom surface 16 of the rail base flange. The important feature to note is that the base piece B is constructed of a length sufficient to provide a central section 17′ having a length equal to that of the joint bar J and includes an exposed terminal Section 17—17 projecting longitudinally beyond each end face 18 of the joint bar foot 5. The foregoing is combined with means projecting upwardly from each top surface 19 of the terminal sections 17 to provide a stop or end abutment member P.

In the embodiment of FIG. 1 the member P will be understood to comprise an integral tab cut out from the terminal section 17 of the base piece B. Such construction is readily achieved by cutting along two lines to permit bending of the tab to the illustrated elevated position thus leaving the cut-out portion 20. This eliminates the need for manufacturing the stop members P separately and thereafter assembling same to the terminal sections 17.

Figure 2:
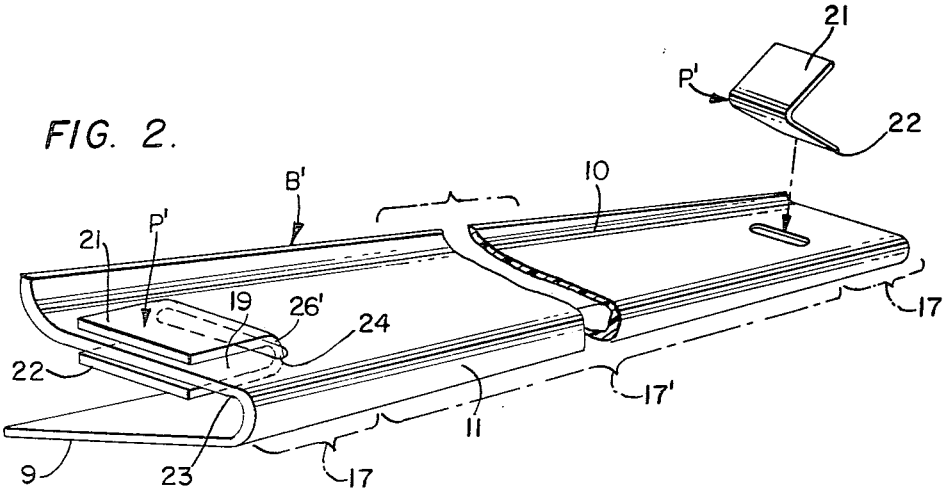
FIG. 2 is a perspective view illustrating a modification of the base piece shown in FIG. 1.

In the embodiment illustrated in FIG. 2, the base piece B′ includes modified end abutment members comprising separate insertable clip components P′ of insulative material each having a top wall 21 and a bottom wall 22 engaging respectively, the terminal section upper arm top surface 19 and undersurface 23. Rigid attachment of the abutment member P′ is achieved by the provision of a transverse cut-out portion comprising the slot 24 through the upper arm 10 along the juncture between the central base piece section 17′ and each exposed terminal section 17—17. When assembled as shown in the left hand portion of FIG. 2 of the drawing, the abutment member P′ will be seen to form a rigidly attached U-clip.

Figure 3:
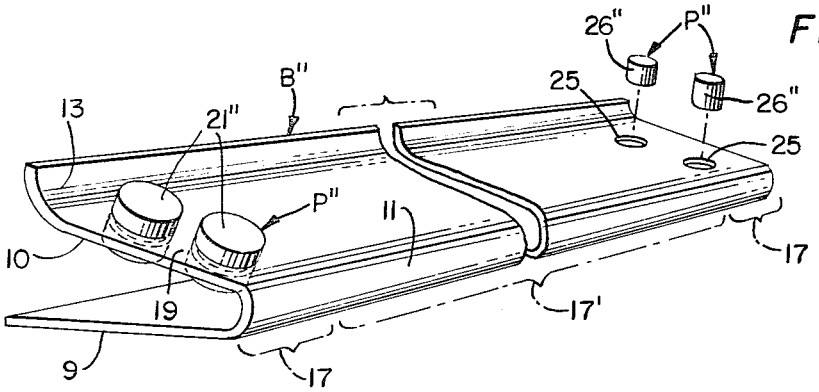
FIG. 3 is a perspective view of a further modification of the base piece as shown in FIG. 1.

In the further modification shown in FIG. 3, the base piece B″ includes the end abutment means likewise comprising separate components and in this instance a plurality of non-metallic rivets P″ are affixed through cut-out portions comprising holes 25 in the upper arm 10 of the base piece terminal sections 17 to provide at each exposed terminal section 17 a pair of transversely spaced apart abutment members each having an elevated peripheral surface disposed along the juncture of the base piece central section 17′ and exposed terminal sections 17—17.

In all modifications of the present invention, the end abutment member will be understood to provide an elevated top wall 21′ (FIG. 1), 21 (FIG. 2) or 21″ (FIG. 3) joined to an inner abutment surface 26, 26′ or 26″ respectively, which surface itself extends normal to the longitudinal axis of the rails and is constantly juxtaposed the adjacent end 18 of the joint bar so that effective means is provided to preclude any longitudinal migration of the base piece B, B′ or B″ in either direction during rail travel over the assembled joint A.

Adaptability of any one of the described base pieces to rail joint assemblies utilizing joint bars of varying lengths is readily accomplished as it will be appreciated that in each case the extent and location of the cut-out portions 20, 24 or 25 may be selectively varied to alter the resultant location of the inner abutment surfaces 26, 26′ or 26″.

I claim:

1. An insulated rail joint including, an adjacent pair of rail sections each having a pair of base flanges, a unitary separate metal joint bar having a head and including a foot provided with opposite end faces disposed adjacent both said rail base flanges on each side of said rail sections, said joint bar including an integral base beneath and spaced from said foot, an insulative base piece intermediate each said joint bar foot and adjacent pair of rail base flanges and having a top surface, each said base piece including a central section entirely disposed between said joint bar and adjacent rail base flanges and bounded by a pair of integral terminal sections projecting beyond said joint bar foot end faces respectively, said insulative base piece provided with an uppper arm having said top surface thereon and a lower arm disposed intermediate said rail base flange and joint bar base, said terminal sections each having an enclosed opening through said upper arm provided with a periphery adjacent both said central section and an end face of said joint bar foot, an end abutment member comprising a separate element attached to each said terminal section through said opening, each said end abutment member comprising a unitary U-shaped clip disposed through one said opening and having a top wall elevated above and overlying one said terminal section upper arm and a connected bottom wall underlying said same terminal section upper arm, and each said end abutment member including an inner abutment surface juxtaposed one said joint bar foot end face whereby, relative longitudinal displacement in either direction between said base piece and joint bar is precluded.

* * * * *